US006918729B2

(12) United States Patent
Hobbs

(10) Patent No.: US 6,918,729 B2
(45) Date of Patent: Jul. 19, 2005

(54) METHOD AND DEVICE FOR TRIMMING A BOOK

(75) Inventor: John N. Hobbs, Hampton, NH (US)

(73) Assignee: Goss International Americas, Inc., Dover, NH (US)

( * ) Notice: Subject to any disclaimer, the term of this patent is extended or adjusted under 35 U.S.C. 154(b) by 6 days.

(21) Appl. No.: 10/385,958

(22) Filed: Mar. 11, 2003

(65) Prior Publication Data

US 2004/0179921 A1 Sep. 16, 2004

(51) Int. Cl.[7] ..... B42B 9/00

(52) U.S. Cl. ..... 412/16; 83/280; 83/869; 83/879; 270/52.18

(58) Field of Search ..... 83/112, 280, 869, 83/879; 412/1, 9, 16; 82/112, 280, 869, 879; 270/52.18

(56) References Cited

U.S. PATENT DOCUMENTS

| | | | | | |
|---|---|---|---|---|---|
| 3,688,619 | A | * | 9/1972 | Yabuta | 83/35 |
| 3,733,947 | A | * | 5/1973 | Bryson, et al. | 83/280 |
| 4,411,350 | A | | 10/1983 | Wolfram | 193/35 |
| 4,505,173 | A | * | 3/1985 | Hartlage | 83/112 |
| 5,187,967 | A | * | 2/1993 | Singh et al. | 72/340 |
| 6,056,492 | A | * | 5/2000 | Hudson | 412/1 |
| 6,134,999 | A | | 10/2000 | Herman | 83/35 |
| 6,152,002 | A | | 11/2000 | Muller | 83/37 |
| 2002/0112579 | A1 | | 8/2002 | Jager | 83/37 |
| 2002/0134647 | A1 | | 9/2002 | Pelka | 198/456 |
| 2003/0214092 | A1 | * | 11/2003 | Horii et al. | 270/52.18 |
| 2004/0134893 | A1 | * | 7/2004 | Duquette | 219/121.67 |

FOREIGN PATENT DOCUMENTS

| | | |
|---|---|---|
| DE | 12 66 275 | 4/1968 |
| DE | 24 30 043 | 1/1975 |

OTHER PUBLICATIONS www.rimasystem.com,"Rotary Knife Trimmer""Rotary Knife Trimmer:RS–830".*

* cited by examiner

*Primary Examiner*—Monica S. Carter
(74) *Attorney, Agent, or Firm*—Davidson, Davidson & Kappel, LLC

(57) ABSTRACT

A method for trimming a single book having a front edge and two side edges includes transporting a book in a transport direction so that the front edge is parallel to the transport direction, cutting the front edge of the book using a first reciprocating knife when the front edge is parallel to the transport direction, transporting the book so that the side edges are parallel to the transport direction, and cutting the side edges using second and third reciprocating knives when the side edges are parallel to the transport direction. A single book trimming device is also provided having a conveyor device for conveying a book in a transport direction, a reciprocating front knife for trimming a front edge of the book, the front knife having a first blade edge parallel to the transport direction of the conveyor at the front knife; and at least one reciprocating side knife for trimming side edges of the book, the side knife having a second blade edge parallel to the transport direction at the side knife.

24 Claims, 3 Drawing Sheets

METHOD AND DEVICE FOR TRIMMING A BOOK

BACKGROUND INFORMATION

The present invention relates to a method and device for trimming a book.

U.S. Pat. No. 3,733,947, hereby incorporated by reference herein, discloses a machine for performing trimming operations upon the front and side edges of a book as the book continues to advance through the machine. The machine includes a front edge trimming table reciprocated in the horizontal direction and receives a book from an infeed conveyor as the table moves in the direction of the conveyor. The book is clamped to the table and the front edge is trimmed. A side edge tables with side edge trimmers is then used to trim the sides of the book when the book is clamped.

U.S. Pat. No. 4,505,173 discloses a three knife cutting machine in which dogs on a conveying chain transport the material to be cut against stops in a cutting station. At the cutting station a pressure plate holds down the book and two reciprocating side knifes and a front knife perform the three cuts.

U.S. Pat. No. 6,056,492 discloses a book trimmer for a book made of signatures and a cover.

In the metal working art, U.S. Pat. No. 5,187,967 discloses laser trimming of forgings, and U.S. Pat. No. 3,588,619 discloses a feeding apparatus for advancing a metal web and pieces cut therefrom.

Rotary knife trimmers, similar to circular saws, are also known, which trim a shingled stream of products, rather than single books. Rima Systems of Huntington Beach, Calif., for example, offers the RS-830 rotary knife trimmer which provides rotary trimming with up to four rotary knives.

BRIEF SUMMARY OF THE INVENTION

An object of the present invention is to increase throughput of a single book trimming device. Another alternate or additional object of the present invention is to simplify knife design for a single book trimming device.

"Book" as defined herein can include any printed product, including magazines.

The present invention provides a method for trimming a single book having a front edge and two side edges, the method comprising: transporting a book in a transport direction so that the front edge is parallel to the transport direction, cutting the front edge of the book using a first reciprocating knife when the front edge is parallel to the transport direction, transporting the book so that the side edges are parallel to the transport direction, and cutting the side edges using second and third reciprocating knives when the side edges are parallel to the transport direction.

By using reciprocating knives cutting the edges parallel to the direction of movement, throughput can be improved and low cost reciprocating knife assemblies may be used to trim a single book. Moreover, similar knife design can be used for all three knives. Higher quality cutting than provided with rotary knives cutting a shingled stream may be provided. Registration of the front cut knife in the direction of travel is not required.

Preferably, the front edge is cut before the side edges, and the spine of the book is registered against a fixed guide as the front edge is cut. Front to spine registration advantageously is provided with a simple low-cost method. Sensitivity to false laps is reduced. Also spine scoring prior to the side knife cuts may be provided.

Preferably, a laser scores the spine at the sides to reduce chipping before the side cuts.

The book preferably is turned 90 degrees in a plane of the book between the front edge cut and the side edge cuts, so that the transport direction is altered 90 degrees.

The book may be stitched, for example on a saddle conveyor, and then turned onto its side before the first cut.

The present invention also provides a single book trimming device comprising: a conveyor device for conveying a book in a transport direction; a reciprocating front knife for trimming a front edge of the book, the front knife having a first blade edge parallel to the transport direction of the conveyor at the front knife; and at least one reciprocating side knife for trimming side edges of the book, the side knife having a second blade edge parallel to the transport direction at the side knife.

Preferably, the conveying device includes a turning unit turning the book 90 degrees in a plane of the book. The turning unit may be an orbital turning unit or in-line turning unit.

Preferably, the front knife is upstream of the side knife. A fixed guide may be provided at the front knife to register the spine of the book against the fixed guide. The conveying device may include a first transport section at an angle to the fixed guide to move the spine against the fixed guide, and a second transport section parallel to the fixed guide.

A laser scoring device may be provided upstream of the side knives, as may be a registration device for the side edges, either head or foot depending on how the book is collated.

A twisted belt may move the book from a stitching device, for example with a saddle-back conveyor, rotate the book from a saddle position to a flat position, and deliver the book to the conveying device.

The reciprocating knives may be of the same construction, and preferably have a linear blade edge that is parallel or at a predefined angle with the plane of the book during the cut. The knives may be for example HT-style knives manufactured by Standard Duplicating Machines Corporation of Andover, Mass., which has the website www.sdmc.com, or may be piston-driven, for example. "Reciprocating knife" as defined herein means that the knife edge moves in and out of the plane of the book to trim the book.

BRIEF DESCRIPTION OF THE DRAWINGS

The present invention is described with respect to the following figures in which.

DETAILED DESCRIPTION

Figure 1:
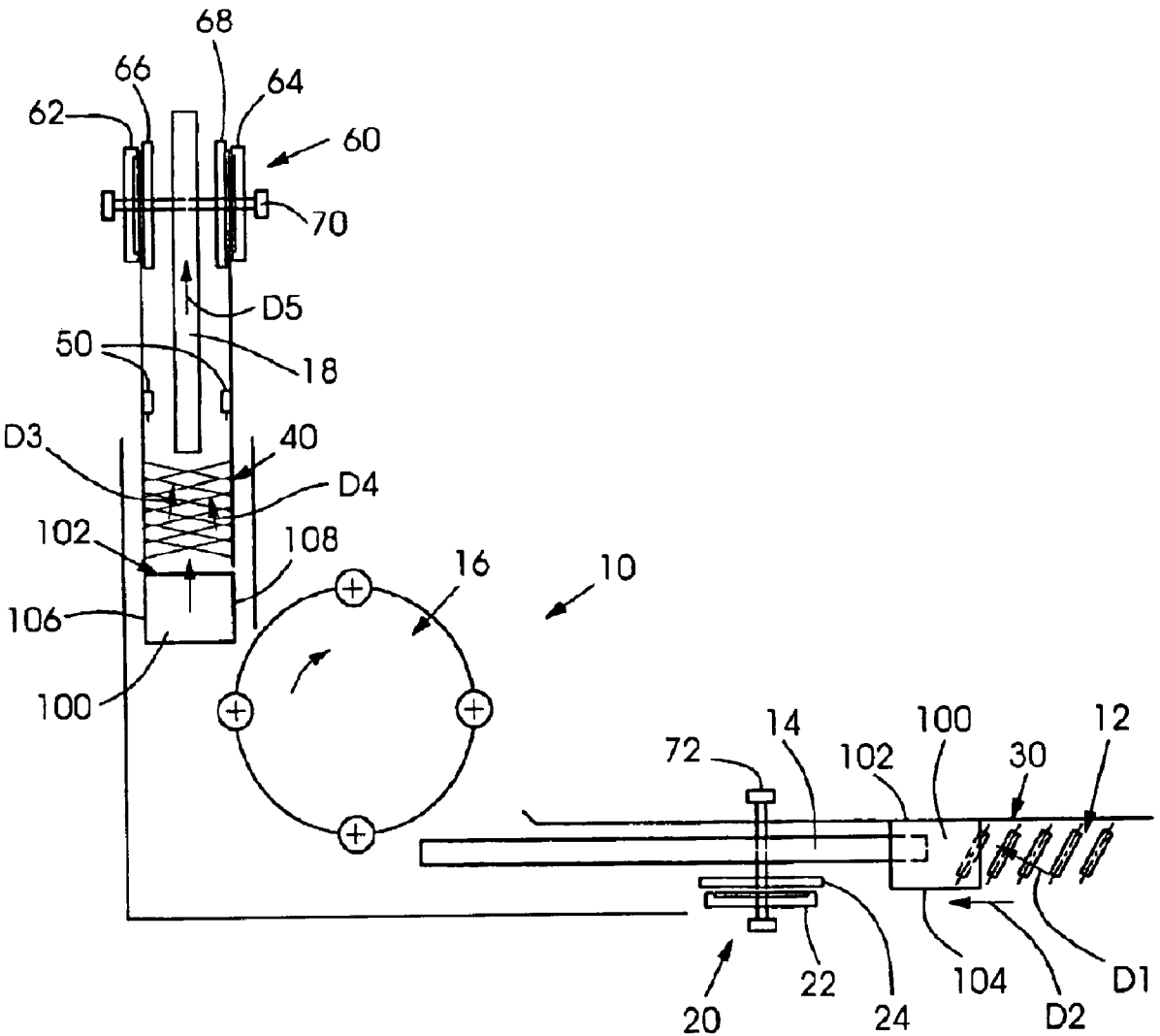
FIG. 1 shows a schematized top view of a first embodiment of the trimming device of the present invention using an orbital turning unit.

FIG. 1 shows a schematized top view of a preferred first embodiment of the present invention, in which an untrimmed book 100 enters a first section 12 of a conveying device 10 conveying the book 100 in a direction D1 slightly angled with respect to a conveying direction D2 of a second section 14 of conveying device 10. First section 12 may include rotating rollers and second section 14 a conveying belt, for example. A spine 102 of book 100 thus is forced against a fixed guide 30 so a front edge 104 of book 100 is properly registered.

In second section 14, book 100 preferably is transported so that the plane of the book is horizontal. A reciprocating knife 22 trims the front edge 104 of book 100 at a front edge cutting station 20. A clamp 24 may be provided to clamp the book 100 during the cut. A drive 72 can reciprocate knife 22.

Conveying device 10 further includes an orbital turn unit 16, which grips the partially trimmed book 100 from section 14, rotates the book in its plane 90 degrees, and transfers book 100 to a registration device 40 of conveying device 10 for registering the head side 106 or foot side 108, depending on how the book is collated. If foot side 108 registration is desired, registration device 40 moves book 100 in direction D3 against a side guide, and if head side 106 registration is desired, registration device 40 moves book 100 in direction D4 against a side guide. The side registered book 100 then passes to a further conveying section 18 of conveying device 10. Laser scoring of the spine 102 may be provided by a laser scoring device 50 at the edges of the spine, which can reduce chipping during the side trimming.

Section 18 then conveys book 100 in conveying direction D5 to an edge cut station 60 having a first reciprocating side knife 62 and second reciprocating side knife 64, as well as respective clamps 66 and 68. A common drive 70 can be provided to reciprocate knives 62, 64.

Book 100 then exits the trimming device fully trimmed. It would also be possible to further rotate the book in its plane 90 degrees to trim the spine with a fourth reciprocating knife, if so desired.

Figure 2:
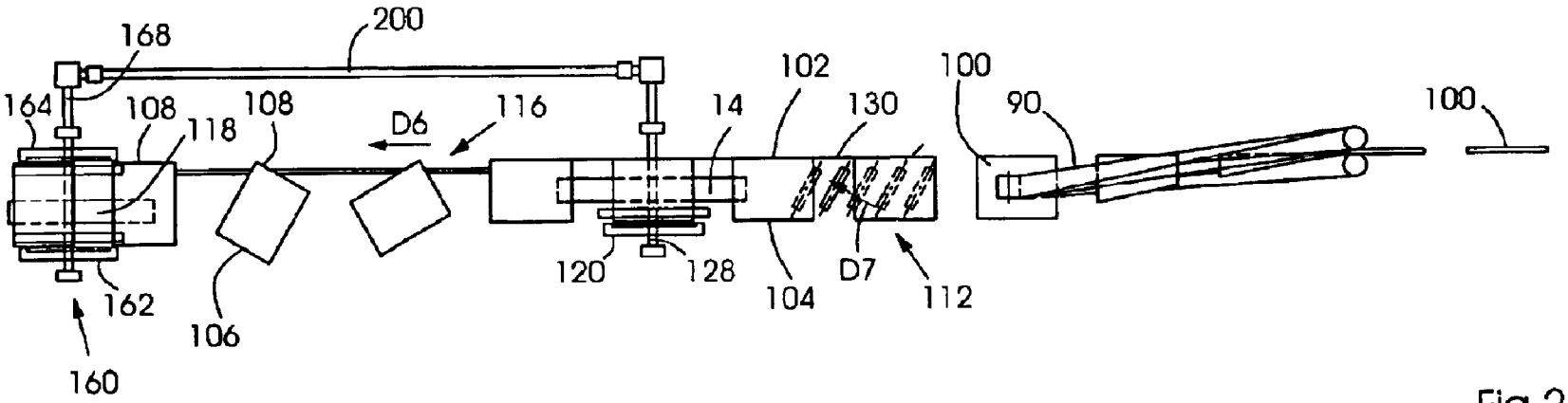
FIG. 2 shows a schematized top view of another embodiment of the trimming device of the present invention using an in-line turning unit.

FIG. 2 shows a top view of an alternate embodiment in which the conveying direction D6 remains the same after the first registration device.

Figure 3:
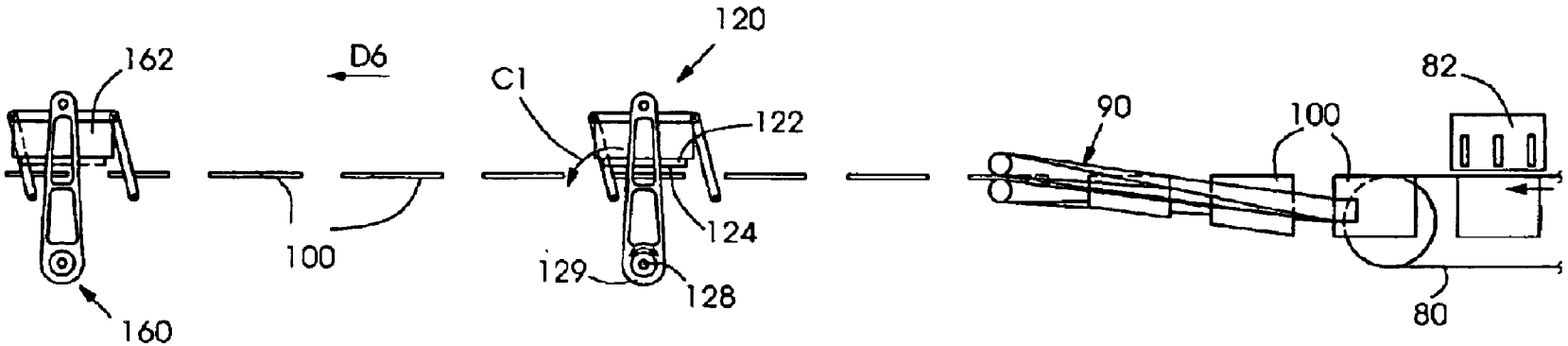
FIG. 3 shows a partial schematized side view of the FIG. 2 embodiment.

As shown schematically in FIG. 3, the books 100 first may be stitched by a stitcher 82 stitching the books on a saddle conveyor 80, where the plane of the book is vertical. Books 100 then transferred to a twisted belt conveyor 90 which twists the books 100 until the plane of the book is horizontal.

Returning to FIG. 2, the books from conveyor 90 are transferred to a first registration device 112 to move in a direction D7 against a fixed guide 130, against which the spine 102 of book 100 is registered, so that the front edge 104 is registered. Front cutting station 120 trims the front edge 104. Cutting station 120 is driven by a drive 200 having a shaft 128. As shown in FIG. 3, drive 128 is fixed to a drive arm 129, which drives knife 122 so that it reciprocates up and down. Knife 122 thus moves in direction C1 to trim the front edge 104. Blade edge 124 can remain parallel to the plane of book 100 or cut the front edge 104 at a predefined angle.

Book 100 can then be rotated in its plane ninety degrees by an in-line turning device 116 which grips an edge of the book and rotates the book as the grippers move linearly. When the book 100 arrives at edge cutting station 160 and is transported by further conveyor section 118, the two side edges 106, 108 are parallel to conveying direction D6, and can be trimmed by reciprocating side knives 162, 164, respectively. Side knives 162, 164 advantageously may be of the same construction as knife 122, and may cut the book at a predefined angle, including parallel to the plane of the book.

Knives 162, 164 may be reciprocated by a drive shaft 168 driven by common drive 200.

What is claimed is:

1. A method for trimming a single book having a front edge and two side edges, the method comprising:

transporting a book in a transport direction so that the front edge is parallel to the transport direction, cutting the front edge of the book using a first reciprocating knife when the front edge is parallel to the transport direction, at the first reciprocating knife and registering the spine before and/or during the cutting of the front edge by contacting the spine against a surface of a fixed guide parallel to the first reciprocating knife, transporting the book so that the side edges are parallel to the transport direction, and cutting the side edges using second and third reciprocating knives when the side edges are parallel to the transport direction.

2. The method as recited in claim 1 wherein the front edge is cut before the side edges.

3. The method as recited in claim 1 wherein a spine of the book is registered against the fixed guide by conveying the book at an angle with respect to the transport direction at the first reciprocating knife to contact the fixed guide.

4. The method as recited in claim 1 further comprising scoring a spine of the book prior to the side edge cutting.

5. The method as recited in claim 4 wherein the scoring is laser scoring.

6. The method as recited in claim 1 wherein the book is turned 90 degrees in a plane of the book between the front edge cut and the side edge cuts.

7. The method as recited in claim 6 wherein the transport direction is altered 90 degrees as the book is turned.

8. The method as recited in claim 6 wherein the transport direction remains the same as the book is turned.

9. The method as recited in claim 1 further comprising turning a book from a vertical to a horizontal position before a first cut.

10. A single book trimming device comprising:

a conveyor device for conveying a book in a transport direction;

a reciprocating front knife for trimming a front edge of the book, the front knife having a first blade edge parallel to the transport direction of the conveyor at the front knife; and at least one reciprocating side knife for trimming side edges of the book, the side knife having a second blade edge parallel to the transport direction at the side knife, the front knife being upstream of the side knife.

11. The trimming device as recited in claim 10 wherein the conveying device includes a turning unit turning the book 90 degrees in a plane of the book.

12. The trimming device as recited in claim 11 wherein the turning unit is an orbital turning unit.

13. The trimming device as recited in claim 10 further comprising a fixed guide at the front knife to register a spine of the book against the fixed guide.

14. The trimming device as recited in claim 13 wherein the conveying device includes a first transport section at an angle to the fixed guide to move the spine against the fixed guide, and a second transport section parallel to the fixed guide.

15. The trimming device as recited in claim 10 further comprising a laser scoring device upstream of the side knife.

16. The trimming device as recited in claim 10 further comprising a registration device upstream of the side knife.

17. The trimming device as recited in claim 10 wherein the side knife and the front knife have a same construction.

18. A book finishing device for a book comprising:

a saddle stitcher;

a first conveyor for conveying the book from a saddle position to a flat position, and a single book trimming device receiving the book from the first conveyor and having a second conveyor for conveying a book in a transport direction, a reciprocating front knife for trimming a front edge of the book, the front knife having a first blade edge parallel to the transport direction of the conveyor at the front knife, and at least one reciprocating side knife for trimming side edges of the book, the side knife having a second blade edge parallel to the transport direction at the side knife.

19. A method for trimming a single book having a front edge and two side edges, the method comprising:

transporting a book in a transport direction so that the front edge is parallel to the transport direction, cutting the front edge of the book using a first reciprocating knife when the front edge is parallel to the transport direction, transporting the book so that the side edges are parallel to the transport direction, and cutting the side edges using second and third reciprocating knives when the side edges are parallel to the transport direction, wherein the front edge is cut before the side edges.

20. A method for trimming a single book having a front edge and two side edges, the method comprising:

transporting a book in a transport direction so that the front edge is parallel to the transport direction, cutting the front edge of the book using a first reciprocating knife when the front edge is parallel to the transport direction, transporting the book so that the side edges are parallel to the transport direction, cutting the side edges using second and third reciprocating knives when the side edges are parallel to the transport direction, and scoring a spine of the book prior to the side edge cutting.

21. The method as recited in claim 20 wherein the scoring is laser scoring.

22. A single book trimming device comprising:

a conveyor device for conveying a book in a transport direction;

a reciprocating front knife for trimming a front edge of the book, the front knife having a first blade edge parallel to the transport direction of the conveyor at the front knife;

at least one reciprocating side knife for trimming side edges of the book, the side knife having a second blade edge parallel to the transport direction at the side knife; and a fixed guide at the front knife to register a spine of the book against the fixed guide.

23. A single book trimming device comprising:

a conveyor device for conveying a book in a transport direction;

a reciprocating front knife for trimming a front edge of the book, the front knife having a first blade edge parallel to the transport direction of the conveyor at the front knife; and at least one reciprocating side knife for trimming side edges of the book, the side knife having a second blade edge parallel to the transport direction at the side knife; and a fixed guide upstream of the front knife,the fixed guide being parallel to the front knife;

the conveying device including a first transport section at an angle to the fixed guide to move the spine against the fixed guide.

24. A single book device comprising:

a conveyor device for conveying a book in a transport direction;

a reciprocating front knife for trimming a front edge of the book, the front knife having a first blade edge parallel to the transport direction of the conveyor at the front knife; and at least one reciprocating side knife for trimming side edges of the book, the side knife having a second blade edge parallel to the transport direction at the side knife, and a laser scoring device upstream of the side knife.

* * * * *